US006653772B1

(12) United States Patent
Van Der Wilk

(10) Patent No.: US 6,653,772 B1
(45) Date of Patent: Nov. 25, 2003

(54) CRT ELECTRON GUN WITH REDUCED STRAY ELECTRON FLOW BETWEEN ELECTRODES

(75) Inventor: Ronald Van Der Wilk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 55 days.

(21) Appl. No.: 08/273,672

(22) Filed: Jul. 12, 1994

(30) Foreign Application Priority Data

Jul. 13, 1993 (BE) ..... 09300720

(51) Int. Cl.[7] ..... H01J 29/02; H01J 29/51

(52) U.S. Cl. ..... 313/417; 313/414

(58) Field of Search ..... 313/417, 414, 313/409, 412, 421, 411, 458, 413, 448, 456, 457

(56) References Cited

U.S. PATENT DOCUMENTS 4,096,408 A * 6/1978 Bozzay et al. ..... 313/417
4,119,884 A * 10/1978 Blumenberg et al. ..... 313/417
4,137,480 A * 1/1979 Torre et al. ..... 313/481
4,181,870 A * 1/1980 Stevens ..... 313/414
4,499,402 A * 2/1985 van der Heijden ..... 313/414
4,595,858 A * 6/1986 Hale ..... 313/414
4,609,848 A * 9/1986 Takenobu ..... 313/417
4,678,964 A 7/1987 Peels
4,853,584 A 8/1989 Inoue
4,990,822 A * 2/1991 Guzowski et al. ..... 313/414
5,140,218 A * 8/1992 Van Eck ..... 313/414
5,479,067 A * 12/1995 van der Wilk et al. ..... 313/417

FOREIGN PATENT DOCUMENTS

DE 2526210 * 12/1976 ..... 313/417
GB 967260 * 8/1964 ..... 313/457

* cited by examiner

*Primary Examiner*—Sandra O'Shea
*Assistant Examiner*—Dalei Dong

(57) ABSTRACT

A cathode ray tube comprising an electron gun. The electron gun has electrodes which are secured to supports by connecting elements. The width of the connecting elements varies. As a result, the high-voltage behavior of the cathode ray tube is improved.

7 Claims, 2 Drawing Sheets

CRT ELECTRON GUN WITH REDUCED STRAY ELECTRON FLOW BETWEEN ELECTRODES

BACKGROUND OF THE INVENTION

This invention relates to a cathode ray tube comprising a display screen and an electron gun having a means for generating electrons, a number of electrodes and a support which is composed of an insulating material, said electrodes being provided with connecting elements which are secured in the support.

Cathode ray tubes are used, inter alia, in television receivers, computer monitors, oscilloscopes etc.

A cathode ray tube of the class mentioned in the opening paragraph is of the conventional type. The electron gun comprises a means for generating electrons, for example, a cathode. The electrodes are provided with connecting elements which are pressed into the support. The support is generally made from glass which can be softened. In the manufacture of the electron gun, the electrodes of the electron gun are stacked on top of each other, whereafter the support is (or are, if more than one support is used) heated. By virtue thereof, the support and the projections can be interconnected. This is generally achieved by pressing the support against the projections. Since the glass has been softened by heating, the connecting elements can be inserted into the support. The connecting elements may be integral with the electrode or they may be secured to the electrode as a separate part. After cooling, the electrodes and the support are secured to each other.

In operation, voltages are applied to the electrodes. Due to said voltages, electro-optical fields are formed between the electrodes. The electrons generated are accelerated and focused by means of said electric fields. Ever higher demands are imposed on the quality of the electron-optical fields. As a result thereof, the number of electrodes in the electron gun and the value of the applied voltages increase. A problem which arises is that sometimes the electrodes themselves can generate electrons. These electrons may hop between the electrodes. Due to this, the cathode ray tube may be damaged, which leads to failure. Such electrons may also land on the display screen, thereby adversely affecting the contrast of the image displayed. These phenomena occur, in particular, at locations where high voltages are applied to the electrodes.

SUMMARY OF THE INVENTION

It is an object of the invention to provide a cathode ray tube of the type mentioned in the opening paragraph, in which one or more than one of the above problems is reduced.

To this end, the cathode ray tube in accordance with the invention is characterized in that the electron gun comprises a pair of electrodes which are arranged one behind the other, said electrodes having connecting elements extending in a plane transverse to the electron beam, the width of the connecting elements of one of the electrodes of the pair of electrodes differing from the width of the connecting elements of the other electrode of the pair of electrodes.

Hopping of electrons between two electrodes can be reduced by varying the width of the connecting elements. In well-known electron guns, the connecting elements of successive electrodes are equal width.

The invention is, inter alia, based on the insight that electrons can readily hop from one electrode to a proximate electrode via a connecting element and to a connecting element of a nearby electrode via the support, and that in this process the edges the connecting elements form an important source of electrons. By making the widths of the connecting different elements, the shortest distance, via the support, between the edge of connecting element of one electrode, and the next electrode is increased.

In a preferred embodiment, the cathode ray tube comprises means for applying voltages to the pair of electrodes, and the voltage applied to the electrode having the widest connecting elements is lower than the voltage applied to the electrode having the narrowest connecting elements.

In particular in this embodiment hopping of electrons is reduced.

BRIEF DESCRIPTION OF THE DRAWINGS

These and other aspects of the invention will be explained in greater detail by means of the accompanying drawing which shows a number of exemplary embodiments of the invention.

In the drawing.

DESCRIPTION OF THE PREFERRED EMBODIMENTS

Figure 1:
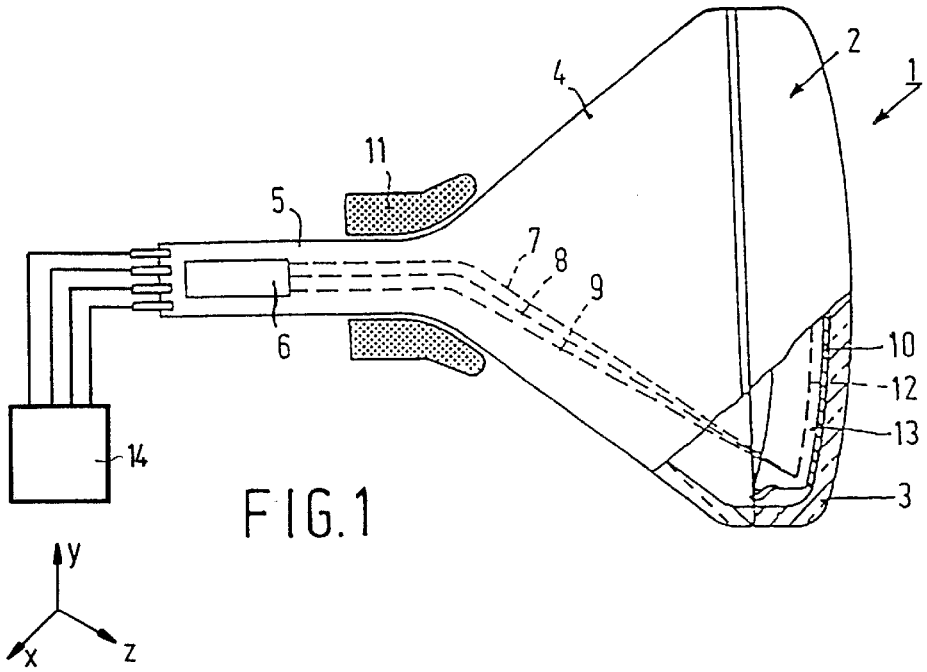
FIG. 1 is a partly perspective view of a cathode ray tube.

The Figures are diagrammatic. In the Figures, like parts generally bear like reference numerals.

FIG. 1 is a partly perspective view of a cathode ray tube 1. Said cathode ray tube 1 comprises an evacuated envelope 2 having a display window 3, a cone 4 and a neck 5. In the neck there is provided an electron gun 6 for generating, in this example, three electron beams 7, 8 and 9. A luminescent display screen 10 which, in this example, comprises phosphor elements luminescing in red, green and blue is situated on the inside of the display window 3. On their way to the screen 10, the electron beams 7, 8 and 9 are deflected across the screen 10 by means of a deflection unit 11 which is located at the junction between the neck and the cone, and pass through the shadow mask 12 which comprises a thin plate having apertures 13. The electron beams 7, 8 and 9 pass through the apertures 13 at a small angle with respect to each other and each electron beam impinges on phosphor elements of only one colour. The means 14 for applying voltages to the electrodes of the electron gun are also diagrammatically shown.

Figure 2:
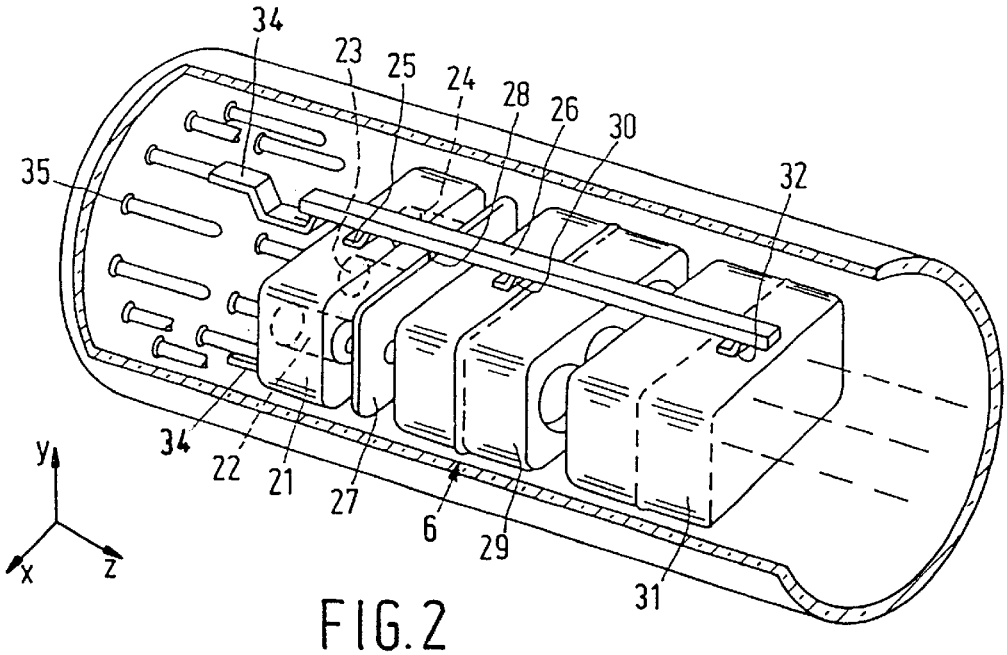
FIG. 2 is a partly perspective view of an electron gun.

FIG. 2 is a diagrammatic, partly perspective view of an electron gun 6. Electron gun 6 comprises a common control electrode 21, also referred to as $G_1$. electrode, in which three cathodes 22, 23 and 24 are secured. The $G_1$, electrode is secured to supports 26 by means of connecting elements 25. Said supports are made of glass. An example of such supports are the supports which are commonly referred to as "beading rods". In this example, the electron gun 6 further comprises a common plate-shaped electrode 27, also referred to as $G_2$ electrode, which is secured to the supports by connecting elements 28. In this example, the electron gun 6 comprises two supports 26. One of said supports is shown, the other is situated on the side of the electron gun 6 which is invisible in this perspective view. The electron gun 6 further comprises the common electrodes 29 and 31 which are also secured to supports 26 by means of connecting elements (30 and 32, respectively). In this example, the supports are secured on feed-through pins 35 by means of brackets 34. The electrical connections between the feed-through pins and the electrodes are not shown.

Figure 3A:
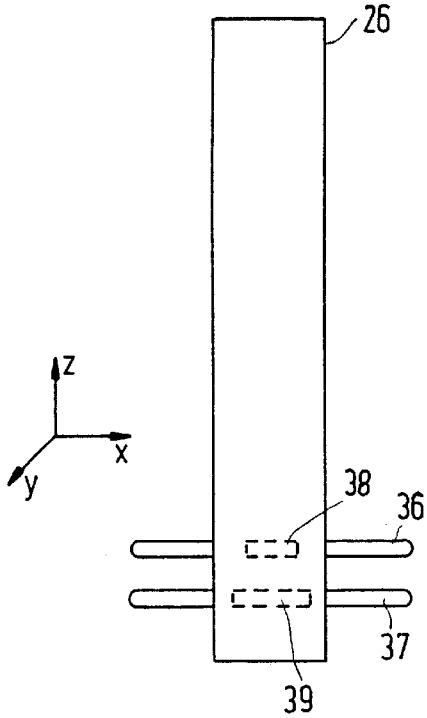
FIGS. 3A and 3B are sectional views of a detail of an electron gun.
Figure 3B:
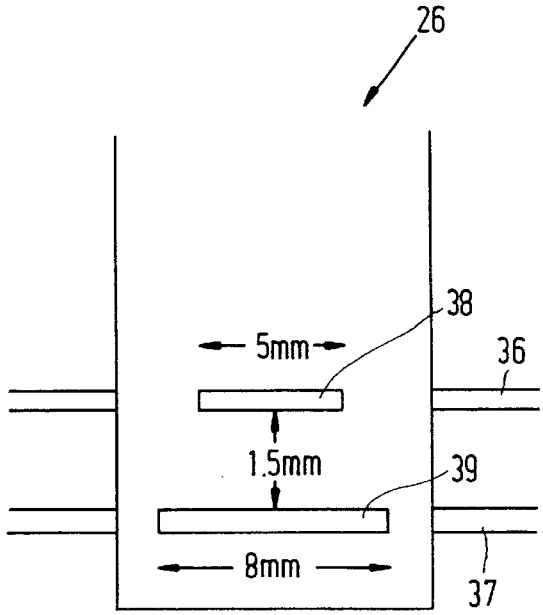
Figure 4:
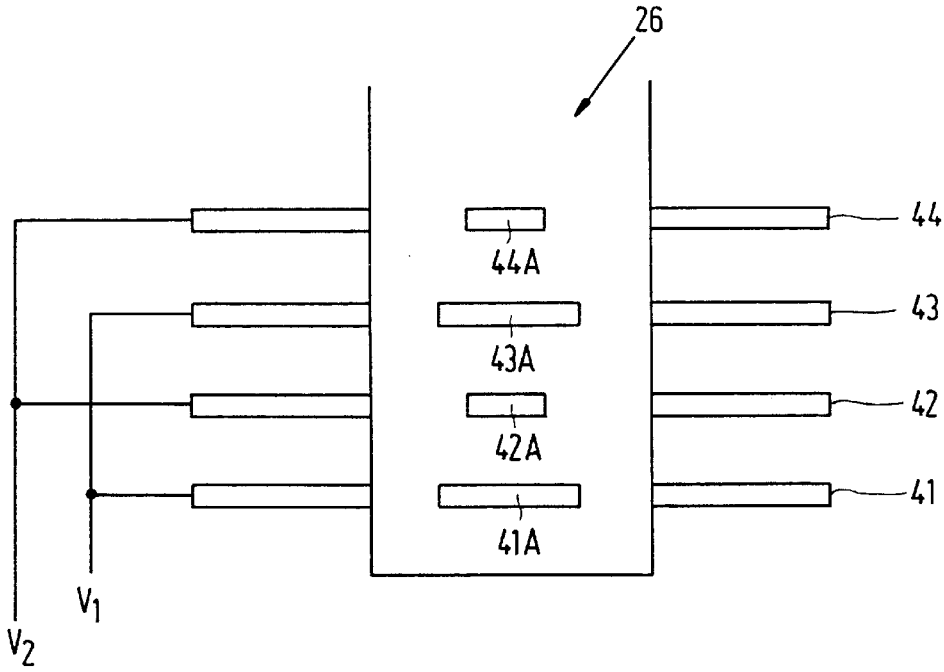
FIG. 4 is a view of a detail of a further example of an electron gun.

FIGS. 3A and 3B are side views of a detail of the electron gun 6. Electrodes 36 and 37 are secured in the support 26 by means of securing elements 38 and 39. Said securing elements 38 and 39 are shown in detail in FIG. 3B. The width of the securing element 39 exceeds that of securing element 38, for example 8 mm (securing element 39) and 5 mm (securing element 38). The distance between the electrodes (in the z-direction) is approximately 1.5 mm. In this example, the voltage applied to electrode 37 is lower than the voltage applied to electrode 36 during operation. Due to this, an electric field is generated between the electrodes. This electric field may cause electrons to hop from electrode 37 to electrode 36. This phenomenon, in which the electrons hop via the support 26, occurs in particular at the edges of the securing elements 39 of electrode 37. In cathode ray tubes in accordance wit the invention, this distance is greater than the distance between the electrodes. In this example, the shortest distance between an edge of securing element 39 and electrode 36, via the support 26, is 2.1 mm, which is more than the distance between the electrodes (=1.5 mm). This reduces the risk of electron hopping. FIG. 4 diagrammatically shows a detail of a further example of an electron gun for a cathode ray tube in accordance with the invention. This electron gun comprises a stack of 4 electrodes 41, 42, 43 and 44 having securing elements 41A, 42A, 43A and 44A, respectively. In operation, voltages $V_1$, and $V_2$ ($V_1 < V_2$) are applied to the electrodes, $V_1$, being applied to electrodes 41 and 43 and $V_2$ being applied to electrodes 42 and 44. The width of the connecting elements 41A and 43A is greater than the width of the connecting elements 42A and 44A. In this example, the widths are 8 mm (41A and 43A) and 5 mm (42A and 44A), respectively. Preferably, the difference in width between the connection elements is greater than the distance between the connecting elements, viewed along the electron beams.

Since the likelihood of electrons hopping between the connecting elements is substantially reduced or absent, damage to the electron gun or contrast reduction does not occur or is reduced in a cathode ray tube in accordance with the invention. A further advantage is that sparking of the electron gun is enhanced. A customary step in the manufacture of an electron gun is the sparking of the electrodes. To this end, very high voltage differences between electrodes are generated. As a result, a flashover is generated between electrodes. By virtue thereof, burrs and loose particles are removed from the electrodes. Flashover between the connecting elements during sparking has two adverse effects. First, flashover between the electrodes does not take place or is less likely to take place and, second, loose particles can be formed. In a cathode ray tube in accordance with the invention, the risk of flashover between the connecting elements is reduced.

It will be obvious that within the scope of the invention further variations are possible.

What is claimed is:

1. A cathode ray tube comprising: a display screen and an electron gun having a means for generating an electron beam, a number of electrodes and a support means which is composed of an insulating material, said electrodes being provided with respective connecting elements which are secured in the support means, wherein the electron gun comprises a pair of electrodes which are arranged one behind the other, said electrodes having the connecting elements extending in a plane transverse to the electron beam, and wherein the width of said connecting elements of one of the electrodes of the pair of electrodes differs from the width of the connecting elements of the other electrode of the pair of electrodes;

said cathode ray tube further comprising means for applying voltages to the pair of electrodes such that, in operation, the voltage applied to the electrode having the widest connecting elements is lower than the voltage applied to the electrode having the narrowest connecting elements.

2. The cathode ray tube as claimed in claim 1 wherein said support means comprise first and second parallel arranged elongate support members extending parallel to a longitudinal axis of the electron gun.

3. A cathode ray tube comprising: a display screen and an electron gun having a means for generating an electron beam, a number of electrodes and a support means which is composed of an insulating material, said electrodes being provided with respective connecting elements which are secured in the support means, wherein the electron gun comprises a pair of electrodes which are arranged one behind the other, said electrodes having the connecting elements extending in a plane transverse to the electron beam, and wherein the width of said connecting elements of one of the electrodes of the pair of electrodes differs from the width of the connecting elements of the other electrode of the pair of electrodes; wherein the difference in width between the connecting elements is greater than the distance between the connecting elements, viewed along the support means.

4. A vacuum tube apparatus comprising:

an evacuated envelope containing display means and an electron gun for generating an electron beam along a longitudinal axis of the electron gun, wherein said electron gun comprises;

at least one support member made of an insulating material;

first and second electrodes each including a connecting element secured in one of the at least one support member so as to mount said first and second electrodes in spaced apart relationship in the direction of the longitudinal axis of the electron gun, wherein the connecting elements extend in planes which are transverse to the electron beam and the connecting element of one of said first and second electrodes is wider than the connecting element of the other one of said first and second electrodes in a direction transverse to the electron beam; and means for applying respective voltages to the one electrode and the other one of said electrodes wherein the voltage applied to the one electrode having the wider connecting element is lower than the voltage applied to the other one of said electrodes which has the narrower connecting element.

5. The vacuum tube apparatus as claimed in claim 4 wherein the distance from one transverse edge of the connecting element of the one electrode to the corresponding transverse edge of the connecting element of the other one of said electrodes is greater than the distance between said connecting elements in a direction parallel to the longitudinal axis.

6. A vacuum tube apparatus comprising:

an evacuated envelope containing display means and an electron gun for generating an electron beam along a longitudinal axis of the electron gun, wherein said electron gun comprises:

at least one support member made of an insulating material;

first and second electrodes each including a connecting element secured in one of the at least one support member so as to mount said first and second electrodes in spaced apart relationship in the direction of the longitudinal axis of the electron gun, wherein the connecting elements extend in planes which are transverse to the electron beam and the connecting element of one of said first and second electrodes is wider than the connecting element of the other one of said first and second electrodes in a direction transverse to the electron beam;

wherein the difference in width between the connecting elements of the one and the other one of said first and second electrodes is greater than the spacing between the connecting elements viewed in a direction parallel to the longitudinal axis of the electron gun.

7. A vacuum tube apparatus comprising:

a. an evacuated envelope containing a display screen and an electron gun for generating an electron, said electron gun including first and second electrodes arranged along an axis;

b. at least one insulating support member extending along said axis;

c. at least one conductive connecting element extending from each of the first and second electrodes and having an end portion secured in the insulating support member, said end portion having a width defined by respective outer edges;

each of said end portions being dimensioned and arranged such that the shortest distance via the insulating support member between any end portion outer edge conductively connected to the first electrode and any end portion outer edge conductively connected to the second electrode is larger than the axial distance between the respective end portions.

* * * * *